US007924135B2

(12) United States Patent
Chen et al.

(10) Patent No.: US 7,924,135 B2
(45) Date of Patent: Apr. 12, 2011

(54) TRANSFORMER

(75) Inventors: Chi-Han Chen, Kaohsiung County (TW); Pao-Nan Lee, Pingtung County (TW)

(73) Assignee: Advanced Semiconductor Engineering, Inc., Kaohsiung (TW)

( * ) Notice: Subject to any disclaimer, the term of this patent is extended or adjusted under 35 U.S.C. 154(b) by 0 days.

(21) Appl. No.: 12/405,024

(22) Filed: Mar. 16, 2009

(65) Prior Publication Data

US 2010/0001827 A1 Jan. 7, 2010

(30) Foreign Application Priority Data

Jul. 3, 2008 (TW) ..... 97125135 A

(51) Int. Cl.

| | |
|---|---|
| ***H01F 27/28*** | (2006.01) |
| ***H01F 21/04*** | (2006.01) |
| ***H01F 27/30*** | (2006.01) |
| ***H01F 7/06*** | (2006.01) |

(52) U.S. Cl. ..... 336/232; 336/115; 336/116; 336/129; 336/182; 336/200; 29/602.1

(58) Field of Classification Search ..... 336/115, 336/116, 129, 182, 200, 232, 121, 125, 130; 29/602.1

See application file for complete search history.

(56) References Cited

U.S. PATENT DOCUMENTS

| | | | | |
|---|---|---|---|---|
| 6,486,765 | B1 | 11/2002 | Katayanagi | |
| 6,972,658 | B1 * | 12/2005 | Findley et al. | 336/200 |
| 2002/0186114 | A1 * | 12/2002 | Basteres et al. | 336/200 |
| 2006/0038621 | A1 * | 2/2006 | Shiramizu et al. | 331/36 L |

FOREIGN PATENT DOCUMENTS

| | | |
|---|---|---|
| CN | 1224062 | 10/2005 |

* cited by examiner

*Primary Examiner* — Elvin G Enad
*Assistant Examiner* — Tszfung Chan
(74) *Attorney, Agent, or Firm* — J.C. Patents

(57) ABSTRACT

A transformer, adapted for being configured in a wiring substrate, is provided. The transformer includes a first plane coil and a second plane coil. The first plane coil includes a plurality of first loops. The second plane coil includes a plurality of second loops. A first bundle constituted by at least two adjacent first loops and a second bundle constituted by at least two adjacent second loops are stridden one over another.

11 Claims, 4 Drawing Sheets

TRANSFORMER

CROSS-REFERENCE TO RELATED APPLICATION

This application claims the priority benefit of Taiwan application serial no. 97125135, filed on Jul. 3, 2008. The entirety of the above-mentioned patent application is hereby incorporated by reference herein and made a part of specification.

BACKGROUND OF THE INVENTION

1. Field of the Invention

The present invention generally relates to a transformer, and more particularly, to transformer configured with an inner wiring inside a wiring substrate.

2. Description of Related Art

In a balance/unbalance filter, mutual inductance can be obtained by mutual coupling magnetic field between two inductors of a transformer, for single end transmission of differential signals. According to the trend of developing miniaturized electronic products, many electronic components have been integrated into a wiring substrate, such as passive components including capacitors, inductors, and resistors.

FIG. 1 illustrates a layout of a conventional transformer. Referring to FIG. 1, a conventional transformer 100 includes two plane coils 110 and 120, substantially positioned at a same plane. Each of the two plane coils 110 and 120 includes a plurality of loops. The loops of the two plane coils 110 and 120 are sequentially arranged one's across another's. With a specific circuit design, mutual inductance between these two plane coils 110 and 120 can be adjusted by adjusting sizes of these two coils. However, such an adjustment also varies self-inductances of the two plane coils 110 and 120. Therefore, the transformer layout employing such a design lacks design flexibility.

FIG. 2 illustrates a layout of another conventional transformer. Referring to FIG. 2, a conventional transformer 200 includes two plane coils 210 and 220, substantially positioned in a same plane and adjacent to one another. The transformer 200 is capable of adjusting mutual inductance between these two plane coils 210 and 220 by adjusting a distance between the two parties. However, even though the change of the distance between the two parties does not vary self-inductances of thereof, this design requires a larger layout area of the transformer 200.

SUMMARY OF THE INVENTION

Accordingly, the present invention is directed to a transformer having an improved design flexibility.

The present invention is also directed to a method for adjusting a mutual inductance, which is adapted for adjusting the mutual inductance without affecting a self-inductance.

The present invention provides a transformer adapted for being configured in a wiring substrate. The transformer includes a first plane coil and a second plane coil. The first plane coil includes a plurality of first loops. The second plane coil includes a plurality of second loops. A first bundle constituted by at least two adjacent first loops and a second bundle constituted by at least two adjacent second loops are stridden one over another.

According to an embodiment of the present invention, a first segment of the first loops is positioned between two adjacent second loops.

According to an embodiment of the present invention, a second segment of the second loops is positioned between two adjacent first loops.

According to an embodiment of the present invention, the wiring substrate includes an insulation layer. Each of the first loops of the first plane coil includes a first general segment, a first crossing segment, and a first conductive via. The first general segment and the first crossing segment of the first loop are positioned at two sides of the insulation layer. The first conductive via is configured passing through the insulation layer for connecting the first general segment and the first crossing segment.

Each of the second loops of the second plane coil includes a second general segment, a second crossing segment, and a second conductive via. The second general segment and the first general segment are positioned substantially in a same plane. The second general segment and the second crossing segment of the second loop are positioned at two sides of the insulation layer. The second conductive via is configured passing through the insulation layer for connecting the second general segment and the second crossing segment.

Projections of the first crossing segments of the first bundle at the plane are crossed with the second general segments of the second bundle, and projections of the second crossing segments of the second bundle at the plane are crossed with the first general segments of the first bundle.

According to an embodiment of the present invention, the first general segment of at least one first loop is crossed with a projection of the first crossing segment of at least another first loop at the plane. The insulation layer is positioned between the first general segment of the at least one first loop and the first crossing segment of the at least another one first loop.

According to an embodiment of the present invention, the second general segment of at least one second loop is crossed with a projection of the second crossing segment of at least another second loop at the plane. The insulation layer is positioned between the second general segment of the at least one second loop and the second crossing segment of the at least another second loop.

The present invention further provides a method for adjusting a mutual inductance for adjusting a mutual inductance between a first plane coil and a second plane coil of a transformer. The first plane coil includes a plurality of first loops, and the second coil includes a plurality of second loops. Each of the first loops includes at least one first inner loop and at least one first outer loop. Each of the second loops includes at least one second inner loop and at least one second outer loop. The first inner loop and the second inner loop are stridden one over another.

The method includes adjusting positions of the first inner loops and the second inner loops for varying an overlapping area between the first inner loops and the second inner loops, while maintaining positions of the first outer loops and the second outer loops unchanged.

According to an embodiment of the present invention, when one of the first inner loops is positioned between two second loops, positions of the first inner loop and the two second loops are adjusted.

According to an embodiment of the present invention, when one of the second inner loops is positioned between two first loops, positions of the second inner loop and the two first loops are adjusted.

Accordingly, while maintaining positions of the first outer loops and the second outer loops unchanged, the present invention is capable of adjusting positions of the first inner loops and the second inner loops for varying an overlapping area between the first inner loops and the second inner loops, so as to adjust the mutual inductance of the transformer. As such, when adjusting the mutual inductance between the first plane coil and the second plane coil, the present invention does not affect self-inductances of the first plane coil and the second plane coil, and won't increase a layout area of the transformer too much.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 2:
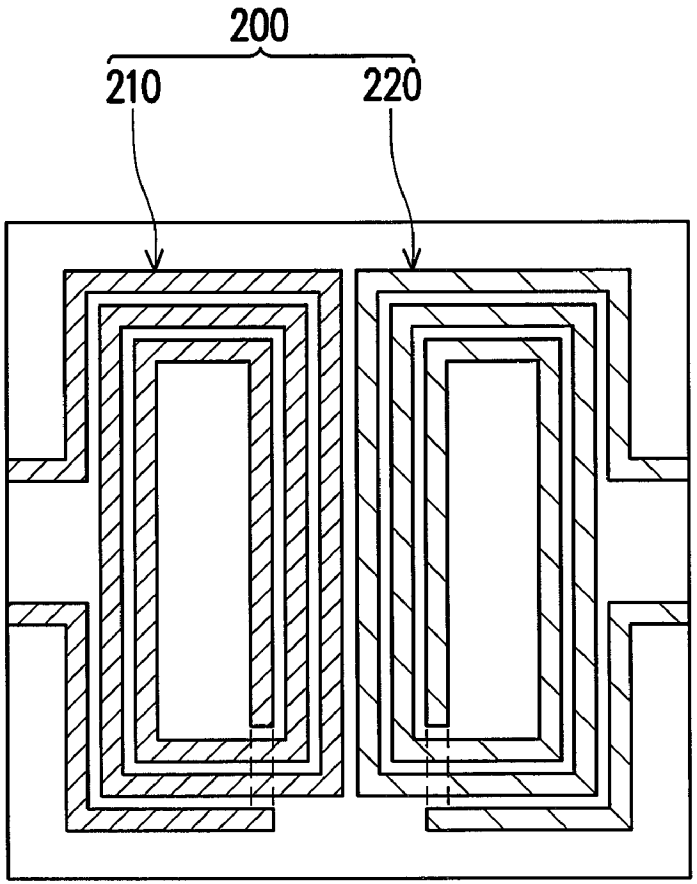
FIG. 2 (PRIOR ART)
FIG. 2 illustrates a layout of another conventional transformer.

Reference will now be made in detail to the present preferred embodiments of the invention, examples of which are illustrated in the accompanying drawings. Wherever possible, the same reference counting numbers are used in the drawings and the description to refer to the same or like parts.

Figure 3:
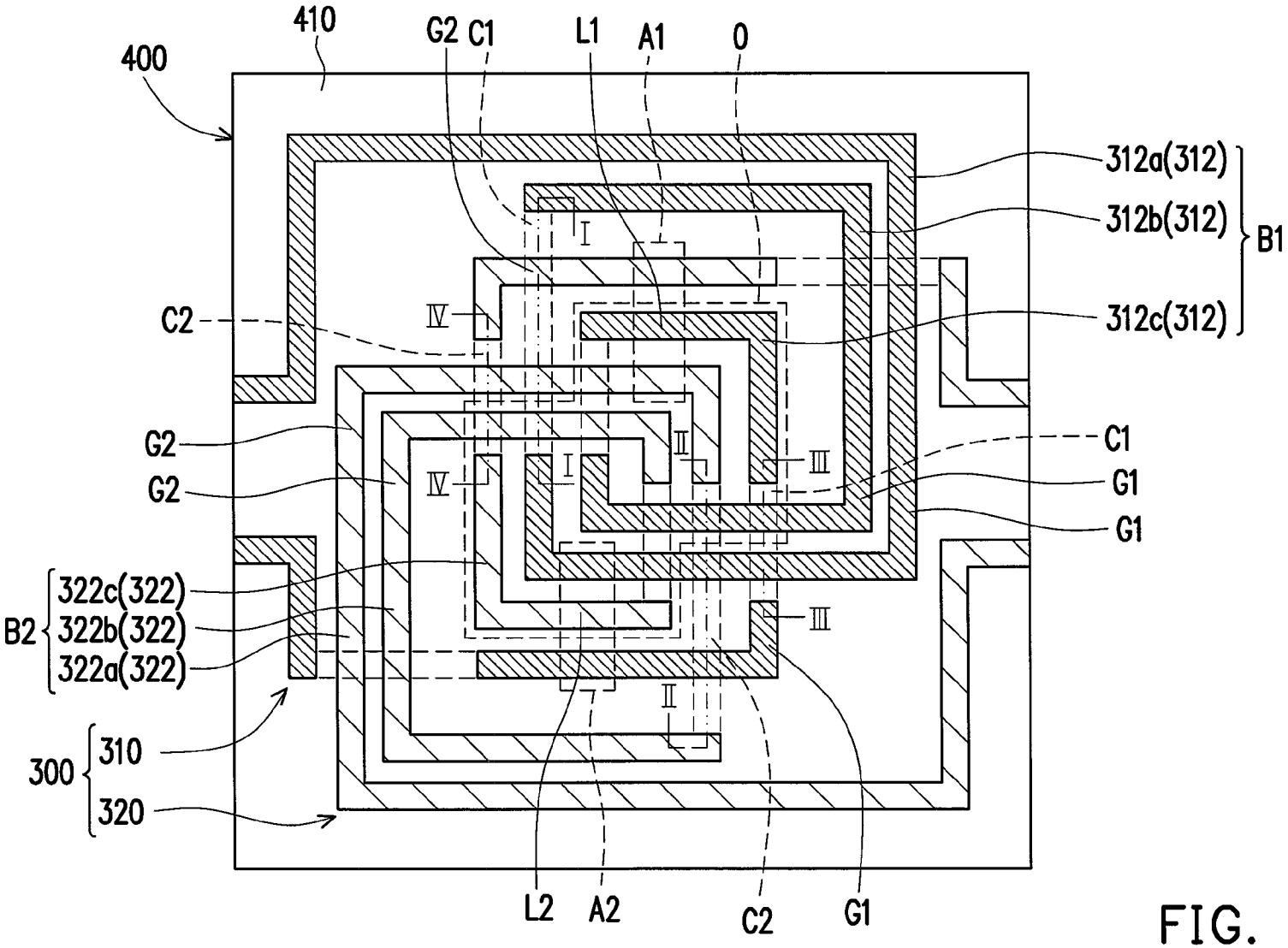
FIG. 3 illustrates a layout of a transformer according to an embodiment of the present invention.

FIG. 3 illustrates a layout of a transformer according to an embodiment of the present invention. Referring to FIG. 3, it shows a transformer 300 for being configured in a wiring substrate 400. The wiring substrate 400, for example, is a printed circuit board (PCB) or an electronic package carrier. The layout of the transformer 300 includes a first plane coil 310 and a second plane coil 320, both of which are constituted by inner wirings of the wiring substrate 400. The wiring substrate 400 includes a plurality of wiring layers, a plurality of insulation layers alternately overlaying with the wiring layers, and a plurality of conductive vias passing through the insulation layers for connecting the wiring layers. The inner wirings of the wiring substrate 400 include the wiring layers and the conductive vias.

The first plane coil 310 includes a plurality of sequentially connected first loops 312 (three first loops 312*a* to 312*c* are exemplified in FIG. 3 for illustration). The second plane coil 320 includes a plurality of sequentially connected second loops 322 (three first loops 322*a* to 322*c* are exemplified in FIG. 3 for illustration). In the current embodiment, a plurality of adjacent first loops 312 constitute a first bundle B1, and a plurality of adjacent second loops 322 constitute a second bundle B2. The first bundle B1 and the second bundle B2 are stridden one over another.

Figure 1:
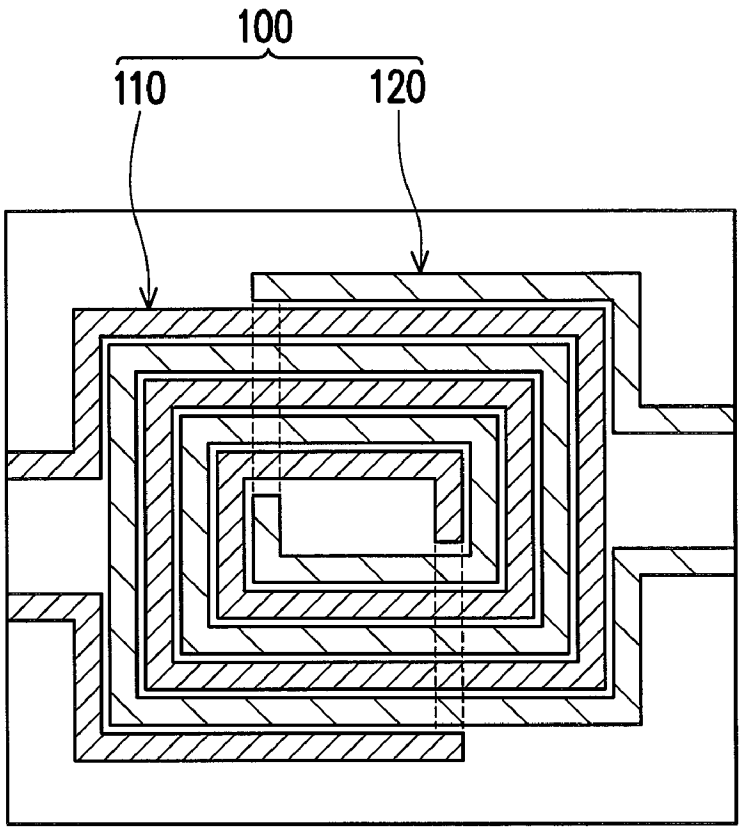
FIG. 1 (PRIOR ART)
FIG. 1 illustrates a layout of a conventional transformer.

In the present embodiment, sizes of the first bundle B1 and the second bundle B2 can be adjusted within a range defined by the outmost first loop 312*a* and the outmost second loop 322*a*, so as to adjust a mutual inductance between the first bundle B1 and the second bundle B2. It should be noted that the adjustment of the mutual inductance between the first bundle B1 and the second bundle B2 does not affect self-inductances of the first bundle B1 and the second bundle B2, and won't increase the layout area of the transformer 300 too much. As such, compared to the conventional transformer 100 as shown in FIG. 1, the transformer 300 according to the embodiment of the present invention has an improved design flexibility.

Referring to a region A1 shown in FIG. 3, in the present embodiment, the first loop 312*c* has a first segment L1 positioned between two adjacent second loops 322*b* and 322*c*. Similarly, referring to a region A2 shown in FIG. 3, in the present embodiment, the second loop 322*c* has a second segment L2 positioned between two adjacent first loops 312*b* and 312*c*.

Figure 4:
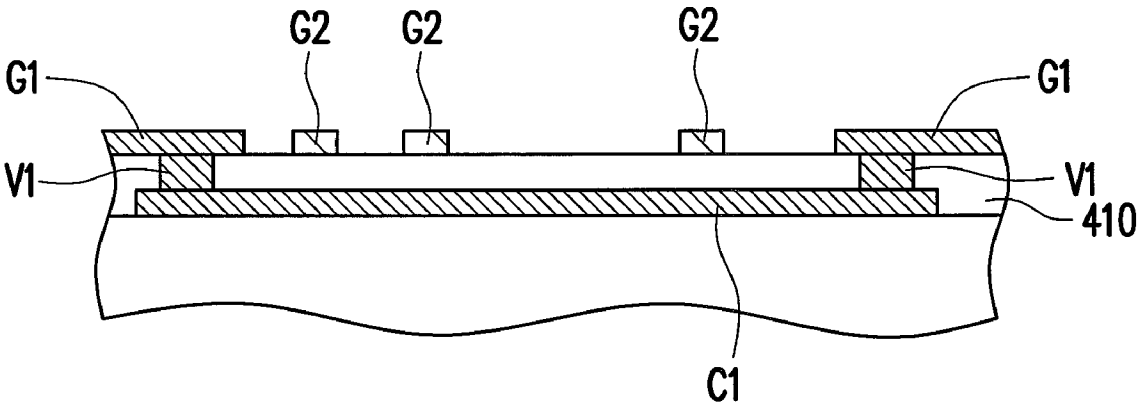
FIG. 4 is a cross-section view of FIG. 3 along line I-I.

FIG. 4 is a cross-section view of FIG. 3 along line I-I. Referring to FIGS. 3 and 4 together, in the present embodiment, the wiring substrate 400 includes an insulation layer 410. Each of the first loop 312 of the first plane coil 310 includes a first general segment G1, a first crossing segment C1, and a first conductive via V1. The first crossing segment C1 and the first general segment G1 are respectively positioned at two sides of the insulation layer 410. The first conductive via V1 is configured passing through the insulation layer 410 for connecting the first general segment G1 and the first crossing segment C1.

Figure 5:
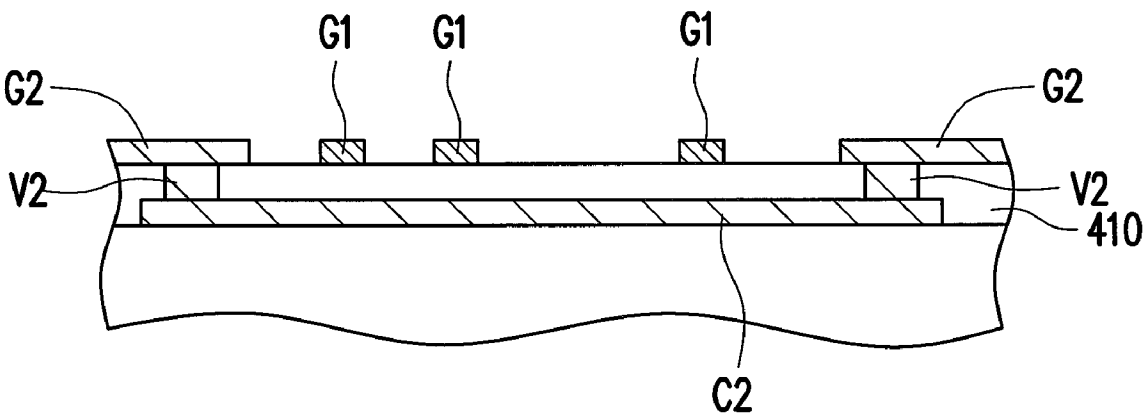
FIG. 5 is a cross-section view of FIG. 3 along line II-II.

FIG. 5 is a cross-section view of FIG. 3 along line II-II. Referring to FIGS. 3 and 5 together, in the present embodiment, each of the second loops 322 of the second plane coil 320 includes a second general segment G2, a second crossing segment C2, and a second conductive via V2. The second general segment G2 and the first general segment G1 are substantially positioned in a same plane. The second crossing segment C2 and the second general segment G2 are respectively positioned at two sides of the insulation layer 410. The second conductive via V2 is configured passing through the insulation layer 410 for connecting the second general segment G2 and the second crossing segment C2.

Referring to FIGS. 3 and 4 again, in the current embodiment, projections of the first crossing segments C1 of the first bundle B1 at the plane are crossed with the second general segments G2 of the second bundle B2. Further, in the present embodiment, the first crossing segments C1 of the first bundle B1 and the second general segments G2 of the second bundle B2 are positioned at two sides of the insulation layer 410.

Referring to FIGS. 3 and 5 again, in the current embodiment, projections of the second crossing segments C2 of the second bundle B2 at the plane are crossed with the first general segments G1 of the first bundle B1. Further, in the current embodiment, the second crossing segments C2 of the second bundle B2 and the first general segments G1 of the first bundle B1 are positioned at two sides of the insulation layer 410.

Figure 6:
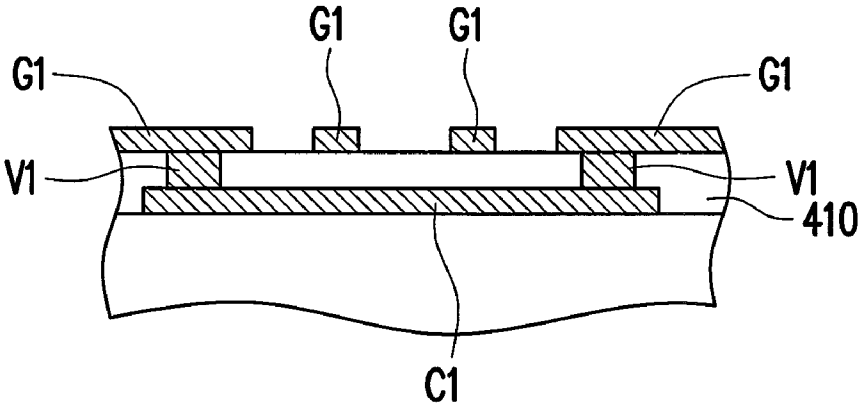
FIG. 6 is a cross-section view of FIG. 3 along line III-III.

FIG. 6 is a cross-section view of FIG. 3 along line III-III. Referring to FIGS. 3 and 6 together, in the current embodiment, first general segments G1 of two first loops 312*a* and 312*b* are crossed with a projection of a first crossing segment C1 of another first loop 312*c* at the plane. The insulation layer 410 is positioned between the first general segments G1 of the two first loops 312*a* and 312*b*, and the first crossing segment C1 of the another first loop 312*c*. It should be noted that the quantities of the first loops crossing at the projection plane are not restricted by the present invention. For example, it may be three first general segments G1 of three first loops crossing with a projection of one first crossing segment C1 of another one first loop at the plane.

Figure 7:
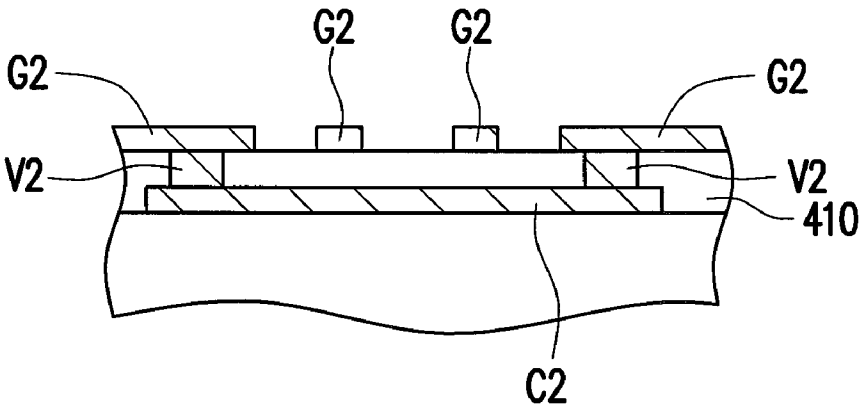
FIG. 7 is a cross-section view of FIG. 3 along line IV-IV.

FIG. 7 is a cross-section view of FIG. 3 along line IV-IV. Referring to FIGS. 3 and 7 together, in the current embodiment, second general segments G2 of two second loops 322*a* and 322*b* are crossed with a second crossing segment C2 of another second loop 322*c* at a projection plane. The insulation layer 410 is positioned between the two second general segments G2 of the two second loops 322*a* and 322*b*, and the second crossing segment C2 of the another second loop 322*c*. It should be noted that the quantities of the second loops crossing at the projection plane are not restricted by the present invention. For example, it may be three second general segments G2 of three second loops crossing with a projection of one second crossing segment C2 of another one second loop at the plane.

Further, referring to FIG. 3 again, according to the current embodiment, in the first loops 312*a* to 312*c*, the first loop 312*c* is more adjacent to a center portion of the first plane coil 310, and thus is attributed as a first inner loop, and the first loops 312*a* and 312*b* are more adjacent to a peripheral of the first plane coil 310, and thus are attributed as first outer loops. Similarly, in the second loops 322*a* to 322*c*, the second loop 322*c* is more adjacent to a center portion of the second plane coil 320, and thus is attributed as a second inner loop, and the second loops 322*a* and 322*b* are more adjacent to a peripheral of the second plane coil 320, and thus are attributed as second outer loops. Further, the self-inductance of the first plane coil 310 can be adjusted by adjusting the first outer loops (i.e., the first loops 312*a*, 312*b* here), and the self-inductance of the second plane coil 320 can be adjusted by adjusting the second outer loops (i.e., the second loops 322*a*, 322*b* here).

According to a method for adjusting the mutual inductance of the transformer 300, the mutual inductance of the transformer 300 can be adjusted by varying an overlapping area O between the first inner loops and the second inner loops by adjusting positions of the first inner loops and the second inner loops, while maintaining positions of the first outer loops and the second outer loops unchanged. As such, the embodiment of the present invention is adapted for adjusting the mutual inductance between the first plane coil 310 and the second plane coil 320 without affecting the self-inductances of the first plane coil 310 and the second plane coil 320.

Referring to a region A1 shown in FIG. 3, in the current embodiment, when the first inner loop is positioned between two second loops 322, the mutual inductance of the transformer 300 can be adjusted by adjusting the positions of the first inner loop and the two second loops 322. Similarly, referring to a region A2 shown in FIG. 3, in the present embodiment, when the second inner loop is positioned between two first loops 312, the mutual inductance of the transformer 300 can be adjusted by adjusting the positions of the second inner loop and the two first loops 312.

In summary, while maintaining positions of the first outer loops and the second outer loops unchanged, the present invention is capable of adjusting positions of the first inner loops and the second inner loops for varying an overlapping area between the first inner loops and the second inner loops, so as to adjust the mutual inductance of the transformer. As such, when adjusting the mutual inductance between the first plane coil and the second plane coil, the present invention does not affect self-inductances of the first plane coil and the second plane coil, and won't increase a layout area of the transformer too much. In such a way, the transformer according to the present invention has an improved design flexibility compared to the conventional art.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A transformer, for being configured in a wiring substrate, comprising:

a first plane coil, comprising a plurality of first loops, wherein the plurality of the first loops comprises a first inner loop and at least two first outer loops; and a second plane coil, comprising a plurality of second loops, wherein the plurality of the second loops comprises a second inner loop and at least two second outer loops, wherein a first bundle constituted by the first inner loop and the at least two adjacent first outer loops and a second bundle constituted by the second inner loop and the at least two adjacent second outer loops are stridden one over another, the first inner loop has a first segment and a second segment physically separate from the first segment, the second inner loop has a third segment and a fourth segment physically separate from the third segment, and the first segment, the second segment, the third segment and the fourth segment are on the same plane, wherein the first segment of the first inner loop is positioned between the fourth segment of the second inner loop and one of the second outer loops and the third segment of the second inner loop is positioned between the second segment of the first inner loop and one of the first outer loops.

2. The transformer according to claim 1, wherein the wiring substrate comprises an insulation layer, each of the first loops of the first plane coil comprising:

a first general segment;

a first crossing segment, wherein the first general segment and the first crossing segment are positioned at two sides of the insulation layer; and a first conductive via, configured passing through the insulation layer for connecting the first general segment and the first crossing segment; and each of the second loops of the second plane coil comprising:

a second general segment, wherein the second general segment and the first general segment are positioned substantially in a same plane;

a second crossing segment, wherein the second general segment and the second crossing segment are positioned at two sides of the insulation layer; and a second conductive via, configured passing through the insulation layer for connecting the second general segment and the second crossing segment, wherein projections of the first crossing segments of the first bundle at the plane are crossed with the second general segments of the second bundle, and projections of the second crossing segments of the second bundle at the plane are crossed with the first general segments of the first bundle.

3. The transformer according to claim 2, wherein the first general segment of at least one first loop is crossed with a projection of the first crossing segment of at least another first loop at the plane, and the insulation layer is positioned between the first general segment of the at least one first loop and the first crossing segment of the at least another first loop.

4. The transformer according to claim 2, wherein the second general segment of at least one second loop is crossed with a projection of the second crossing segment of at least another second loop at the plane, and the insulation layer is positioned between the second general segment of the at least one second loop and the second crossing segment of the at least another second loop.

5. A method for adjusting a mutual inductance, for adjusting a mutual inductance between a first plane coil and a second plane coil of a transformer, wherein the first plane coil comprises a plurality of first loops, and the second coil comprises a plurality of second loops, each of the first loops comprises at least one first inner loop and at least one first outer loop, and each of the second loops includes at least one second inner loop and at least second outer loop, wherein the first inner loop and the second inner loop are stridden one over another, the method comprising:

adjusting positions of the first inner loops and the second inner loops for varying an overlapping area between the first inner loops and the second inner loops, while maintaining positions of the first outer loops and the second outer loops unchanged.

6. The method for adjusting a mutual inductance according to claim 5, wherein when one of the first inner loops is positioned between two second loops, positions of the first inner loop and the two second loops are adjusted.

7. The method for adjusting a mutual inductance according to claim 5, wherein when one of the second inner loops is positioned between two first loops, positions of the second inner loop and the two first loops are adjusted.

8. A transformer, for being configured in a wiring substrate, comprising:

a first plane coil, comprising a plurality of first loops;

a second plane coil, comprising a plurality of second loops, wherein a first bundle constituted by at least two adjacent first loops and a second bundle constituted by at least two adjacent second loops are stridden one over another, one of the at least two first loops has at least two physically separate first segments, while one of the at least two second loops has at least two physically separate second segments, the first segments are directly adjacent to the second segments and the first and second segments are on the same plane, the wiring substrate comprises an insulation layer, and each of the first loops of the first plane coil comprising:

a first general segment;

a first crossing segment, wherein the first general segment and the first crossing segment are positioned at two sides of the insulation layer;

a first conductive via, configured passing through the insulation layer for connecting the first general segment and the first crossing segment; and each of the second loops of the second plane coil comprising:

a second general segment, wherein the second general segment is positioned substantially in a same plane with the first general segment and electrically disconnected with the first general segment;

a second crossing segment, wherein the second general segment and the second crossing segment are positioned at two sides of the insulation layer; and a second conductive via, configured passing through the insulation layer for connecting the second general segment and the second crossing segment, wherein projections of the first crossing segments of the first bundle at the plane are crossed with the second general segments of the second bundle, and projections of the second crossing segments of the second bundle at the plane are crossed with the first general segments of the first bundle.

9. The transformer according to claim 8, wherein a second segment of the second loops is positioned between a fifth segment of one of the first loops and a sixth segment of another one of the first loops which is adjacent to said one of the first loops, the fifth segment, the sixth segment and the second segment are on the same plane, and the second segment is directly adjacent to the fifth segment and the sixth segment.

10. The transformer according to claim 8, wherein the first general segment of at least one first loop is crossed with a projection of the first crossing segment of at least another first loop at the plane, and the insulation layer is positioned between the first general segment of the at least one first loop and the first crossing segment of the at least another first loop.

11. The transformer according to claim 8, wherein the second general segment of at least one second loop is crossed with a projection of the second crossing segment of at least another second loop at the plane, and the insulation layer is positioned between the second general segment of the at least one second loop and the second crossing segment of the at least another second loop.

* * * * *